United States Patent [19]

Turner

[11] 4,281,775

[45] Aug. 4, 1981

[54] CAN TAPPING VALVE APPARATUS

[76] Inventor: Frank J. Turner, 1539 Roundtable Dr., Dallas, Tex. 75247

[21] Appl. No.: 3,309

[22] Filed: Jan. 15, 1979

[51] Int. Cl.[3] ..... B67B 7/24; B65D 83/14

[52] U.S. Cl. ..... 222/82; 222/5; 222/83; 222/91; 222/501; 222/509; 222/520; 222/394; 222/396; 137/318; 137/322; 137/860; 251/82; 251/347

[58] Field of Search ..... 222/5, 394, 396, 82, 222/83, 83.5, 89, 91, 501, 509, 520, 529; 141/329, 348, 349, 19; 251/347–349, 82; 137/318, 322, 71, 860

[56] References Cited

U.S. PATENT DOCUMENTS

| | | | |
|---|---|---|---|
| 375,253 | 12/1887 | Bersch | 251/349 X |
| 1,275,783 | 8/1918 | Steinmetz | 251/348 |
| 2,561,578 | 7/1951 | Koester | 222/527 X |
| 2,886,219 | 5/1959 | Van Baarn | 222/520 X |
| 2,892,614 | 6/1959 | Majneri | 251/348 X |
| 3,092,291 | 6/1963 | Franck | 222/83 |
| 3,817,302 | 6/1974 | Kowal et al. | 222/5 X |

FOREIGN PATENT DOCUMENTS

| | | | |
|---|---|---|---|
| 1901958 | 8/1970 | Fed. Rep. of Germany | 251/349 |
| 306383 | 3/1933 | Italy | 222/520 |

*Primary Examiner*—Charles A. Marmor
*Attorney, Agent, or Firm*—Hubbard, Thurman, Turner, Tucker & Glaser

[57] ABSTRACT

Apparatus for controllably transferring fluid from a pierceable pressurized container includes a valve body, a stem member which is threadably connected to the valve body at one end and a fluid-conducting hose at the other end, and an elastomeric valve ball disposed in a cavity between the body and the stem member. The valve ball controls fluid flow from the container through the valve body and stem member to the hose in response to rotation of the valve stem relative to the body. Simultaneously, the valve balls acts as a check valve to prevent flow of fluid to the container. An O-ring seal between the stem and the valve body is adapted to leak at high pressure and bleed off fluid.

2 Claims, 4 Drawing Figures

CAN TAPPING VALVE APPARATUS

BACKGROUND OF THE INVENTION

This invention relates to apparatus for transferring fluid from pressurized containers and more particularly to can-tapping fluid control valve apparatus.

Although not limited to use with air-conditioning systems, the present invention is particularly useful in recharging such systems. Air-conditioning systems for vehicles or buildings generally employ a compressible working fluid or refrigerant. While such systems are generally well sealed, some of the refrigerant is inevitably lost and must be replaced. If major repairs of the system are required, the entire refrigerant charge may have to be replaced. The commonly used refrigerants are conveniently packaged in small disposable containers or cans holding, for example, one pound each. Instead of having an integral outlet valve, these cans typically have a pierceable top seal which may be pierced by some type of tapping mechanism to gain access to the can and allow the fluid to be conducted by a hose to an air-conditioning system inlet.

The tapping mechanism is typically part of a control valve and safety valve arrangement. A control valve is needed to provide controlled flow of the pressurized fluid from the can. One way valve means are normally employed to prevent accidental flow of pressurized fluid back into the can. Such flow into the can would raise the internal pressure level and would cause the can to explode. For similar reasons, a safety valve is sometimes employed to vent fluid when excessive pressure is encountered.

References known to the applicant which may be relevant to the invention include U.S. Pat. No. 3,817,302 issued to Kowal et al in June of 1974, U.S. Pat. No. 2,536,836, issued to Bowling on Jan. 2, 1951, U.S. Pat. No. 1,275,783 issued to Steinmetz on Aug. 13, 1918, U.S. Pat. No. 2,865,410 issued to Neely on Dec. 23, 1958, and U.S. Pat. No. 3,509,905 issued to Mullins on May 5, 1970.

The Kowal Patent discloses a can tapping valve apparatus using separate elements for controlling the fluid flow, for stopping the reverse flow and for regulating pressure. This apparatus taught by Kowal is complicated and requires a number of separate parts, each performing an individual function. In particular, a flow control valve, a check valve and pressure regulating elements operate independently.

The Steinmetz and Bowling Patents each teach generally the use of a spherical ball in a fluid flow control valve. Neither of these devices is particularly adaptable for use as a can tapping valve as in the present invention. The Bowling device, for example, is relatively complicated and requires considerable machining to manufacture and thus would be a relatively expensive flow control valve.

The Neely and Mullins Patents teach apparatus for providing access to a container or pipe having some form of piercing point and a valve. Each employ an air valve core of the type employed in automotive tire valves. Such devices are not believed to be adaptable for use as a can tapping valve according to the present invention.

The can tapping valve of the present invention has particularly applicability as a consumer unit to be used in adding refrigerant fluid to refrigeration systems, particularly, automotive or residential air-conditioning systems. Such applications require inexpensive and uncomplicated devices, and prior art systems have not satisfied the demand.

For such use it is desirable, as taught by Kowal, that some pressure relief means be provided to avoid excessive pressure conditions in case the flow control valve has been connected to a high pressure source of fluid instead of a low pressure source. While some prior art systems have provided for pressure relief, a simpler and less expensive means has been needed.

SUMMARY OF THE INVENTION

Accordingly, an object of the present invention is to provide an improved and simplified one-way and shut-off can tapping valve arrangement.

Another object of the present invention is to provide a can tapping valve having a combination one-way and flow control valve.

Another object of the present invention is to provide a can tapping valve having a simplified pressure relief means.

A can tapping valve according to the present invention comprises a body portion and a stem portion, each having a longitudinal flow passage with the stem threaded into a first end of the flow passage in the body. A can piercing point and sealing means is carried in a second end of the flow passage in the body. A valve seat is formed in the body flow passage intermediate the first and second ends and a valve ball is positioned between the seat and the valve stem. The valve ball is urged against the valve seat by the valve stem to control flow rate and in addition, functions as a one-way check valve. A fluid seal between the valve stem and body is adapted to allow fluid leakage when excessive pressures are encountered at the can tapping valve outlet.

BRIEF DESCRIPTION OF THE DRAWINGS

The present invention can be better understood by reading the following detailed description of the preferred embodiment with reference to the accompanying drawings wherein.

DESCRIPTION OF THE PREFERRED EMBODIMENTS

Figure 1:
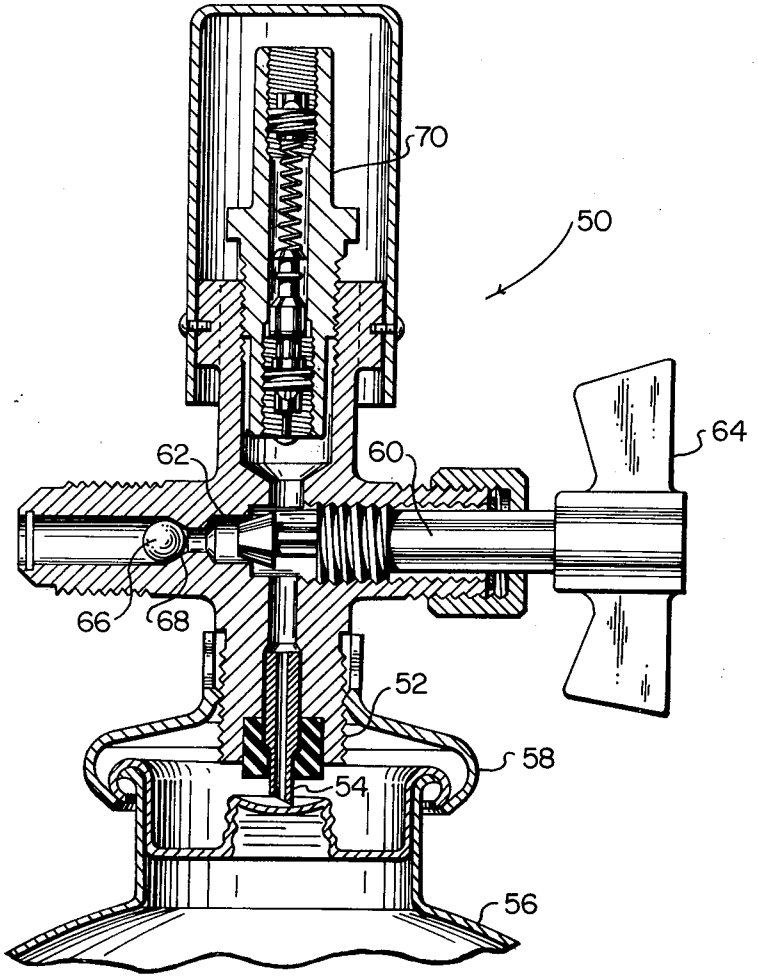
FIG. 1 (PRIOR ART)
FIG. 1 is a cross-section side view of a can tapping unit of the prior art.

Looking first at FIG. 1, a prior art can tapping valve is shown which includes a valve arrangement 50 having a threaded portion 52 on one end carrying a can tapping point 54 and sealing means which provides access to a can 56 of pressurized fluid. As taught therein, a can gripper 58 is generally attached to the top of the pierceable pressurized fluid container 56. The valve body is threaded into the gripper 58 until the piercing point 54 pierces a portion of the can to place the valve in communication with the pressurized fluid. Within the body of the apparatus, there is a conventional valve stem 60 and seat 62 having an external handle 64 for driving the valve stem 60 into contact with seat 62 to thereby control the flow of the fluid from the pressurized container. Beyond the valve seat 62 there is an additional check valve comprising a valve ball 66 and a seat 68 which allows fluid to flow only from the container and not back into the container. The apparatus taught by Kowal additionally includes a pressure relief valve 70 in communication with the pressurized container for venting fluid in the event excessive pressures are encountered.

Figure 2:
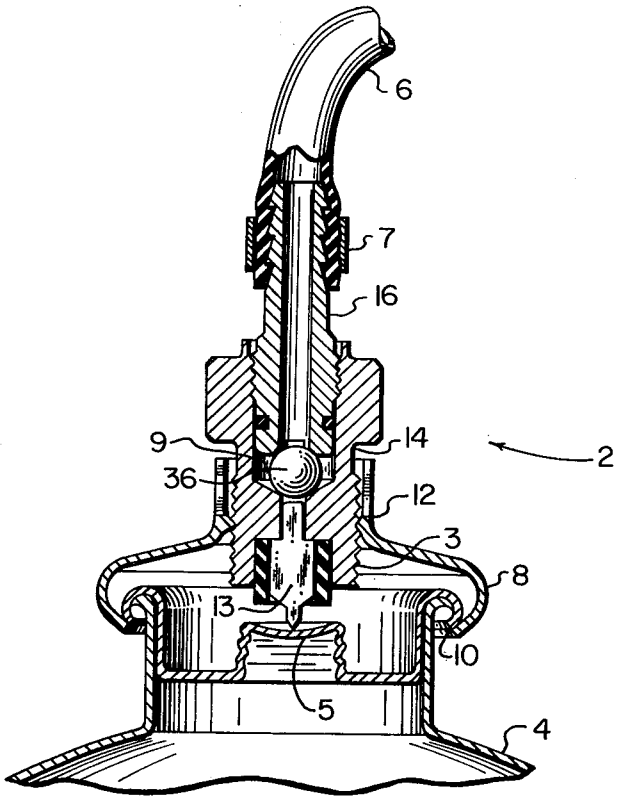
FIG. 2 is a cross-sectional illustration of can tapping valve apparatus according to the present invention, coupling fluid from a pressurized container into a fluid conduit.

FIG. 2 shows a can tapping valve apparatus 2 according to the present invention connecting a pressurized fluid container 4 to a fluid conduit 6. Valve apparatus is attached to container 4 by a conventional gripping means 8. The lower portion 14 of valve 2 has external thread 3 for mating with internal threads in a neck portion 12 of gripping means 8. Gripping means 8 may be integral with container 4, but is more commonly a separate part snapped onto a rim 10 on container 4. The top of container 4 includes a pierceable seal 5 which valve 2 contacts when threaded into gripping means 8. A piercing member 13 is carried in the lower end of valve 2 to pierce the seal 5 and place valve apparatus 2 in communication with the interior of the container 4.

Figure 3:
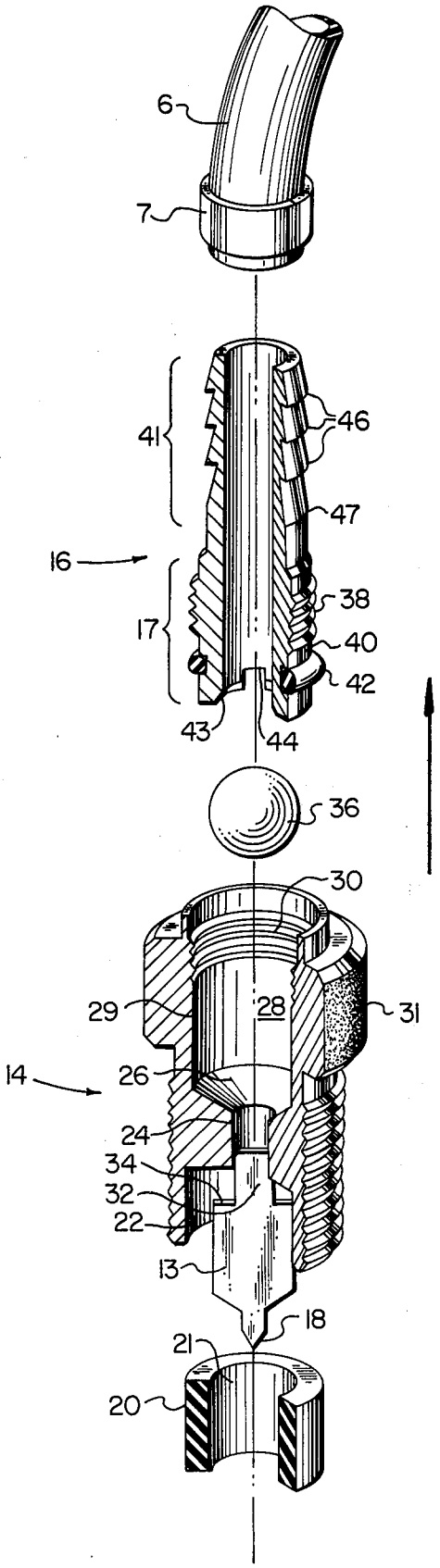
FIG. 3 is an exploded view of the can tapping valve apparatus of FIG. 2.

With reference now to both FIGS. 2 and 3, the can tapping valve apparatus is illustrated in greater detail. The valve apparatus comprises a body member 14, and a stem member 16. In addition, piercing member 13 and fluid seal 20 are carried within a cavity 22 in the lower end of body member 14. The cavity 22 forms part of a continuous flow passage 24 which extends along the length of body 14. A tapered valve seat 26 is formed in the flow passage 24 generally near the center of the body member 14.

While the illustrated tapered seat 26 is preferred, it will be appreciated that another shape such as squared-off seat would also be suitable. Adjacent valve seat 26, a cavity 28 of the flow passage 24 is provided with a smooth wall 29. Another portion 30 beyond cavity 28 is provided with an internal thread for mating with the stem member 16. An outer surface 31 of the upper part of body member 14 is knurled to provide a good grip for threading the valve 2 into the gripping means 8.

In one preferred embodiment, a cylindrical rubber section 20 having a cylindrical opening 21 is contact fitted with cavity 22. Piercing number 13 is stamped from sheet metal with a narrowed shank 32 which fits tightly within the narrowed portion of flow passage 24 and a shoulder 34 for abutting the bottom of the cavity and fitting tightly within the opening 21. A pointed tip 18 extends outward from member 13 for piercing a can top.

An end portion 17 of stem member 16 is adapted for fitting within cavity 28 of body member 14. Portion 17 of stem 16 has external threads 38 adapted for mating with threads 30 in cavity 28.

Figure 4:
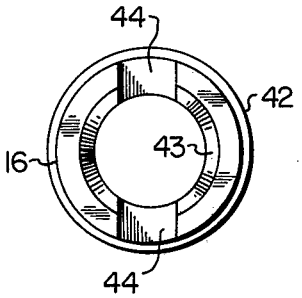
FIG. 4 is an end view of the stem of the apparatus of FIG. 3.

Next to threads 38 is a smooth walled section 40 carrying an O-ring 42 for sealing against the smooth wall 29 of cavity 28. At the end of end portion 17 an inner tapered valve seat 43 forms an end wall for cavity 28. As best seen in FIG. 4, seat 43 is tapered to correspond to seat 26 but has a cross-cut groove 44 providing two fluid paths for communicating with flow passageway 24.

A barbed end 41 is disposed opposite end portion 17 on stem member 16. End 41 includes a hollow cylindrical portion 47 extending beyond threads 38 and tapering to a plurality of serially spaced cylindrical ridges 46 for insertion in tube 6 to provide a fluid tight seal. Tubing 6 is sealed to stem 16 by means of a brass sleeve 7, which is crimped around the tube 6 to abut ridges 46.

Cavity 28 and valve seat 43 form a chamber 9 (FIG. 1) for containing a spherical valve ball 36, preferrably formed of an elastomeric material such as neophrene rubber. Ball 36 has a diameter selected to loosely fit in chamber 9 and to seat tightly on valve seat 26, thereby forming a seal to allow fluid flow only from the body through the step of the valve apparatus 2, as shown by the arrow.

As best illustrated in FIG. 2, variable fluid flow control is achieved by assembling the can tapping valve apparatus 2 so that stem 16 urges valve ball 36 against seat 26. The position of valve ball 36 relative to seat 26 is adjusted by rotating the stem 16 with respect to body portion 14. When valve apparatus 2 is connected to container 4, as illustrated in FIG. 1, this control is achieved by rotating container 4 relative to tubing 6.

In practice, it has been found that O-ring 42 provides an effective fluid tight seal between stem 16 and body 14 up to about 125 pounds per square inch. This pressure level is quite adequate for all normal uses of the apparatus. If conduit 6 is inadvertently connected to the high pressure line of air-conditioner compressor, pressure greatly in excess of this level will be applied to the outlet, that is, the stem member 16 of valve apparatus 2. Under such circumstances, valve ball 36 is urged against seat 26 to block the excessive pressure from the container 4, and thereby avoid a dangerous explosion of the container. In addition, such a high pressure condition will cause leakage of fluid past O-ring 42 which will aid in reducing pressure within the flexible hose 6 to reduce the chance of explosion of the hose and provide a signal to the user that an excessively high pressure condition exists. A similar type of safety valve function would occur if container 4 were heated to drive fluid through the valve tube while tubing 6 is accidentally connected to a closed inlet valve on, for example, a compressor.

In use, the can tapping valve apparatus is initially assembled with the stem 16 threaded fully into the body 14 to force the valve ball 36 against the seat 26 to place the valve in a closed position. The tube 6 is permanently connected to stem 16 by the crimped ring 7. The tubing 6 normally carries a conventional fitting (not shown), permanently connected to its end opposite the valve apparatus adapted for connection to an appropriate inlet port such as the port of an air-conditioning compressor. If container 4 does not carry an integral gripping means 8, then the separate gripping means 8 is snapped onto the rim 10 of the container 4. The valve apparatus 2 is then threaded manually into the neck 12 of the gripping means 8 and turned by means of the knurled portion 31 until the pointed tip 18 contacts the pierceable seal 6. At this point, additional force is applied to the knurled portion 31 to force tip 18 to penetrate seal 5 and to form a fluid tight seal using rubber section 20 between valve apparatus 2 and container 4. After this is done, valve apparatus 2 has been placed in communication with container 4 and fluid may be released through flow passageway 24 and chamber 9 to hose 6 by rotating the hose relative to the container. This may be done by gripping the knurled portion 31 of body 14 in one hand, while turning the crimped sealing band 7 with the other. In practice, it has been found more convenient to grip the entire container 4 and rotate it and valve body 14 as a unit while holding hose 6 in the other hand. The fitting on the opposite end of hose 6 is generally connected to an inlet port of an air-conditioning compressor loosely while some refrigerant is allowed to flow through valve 2 to flush air from hose 6. After sufficient flushing of air has occurred, the fitting is tightened on the compressor and the compressor inlet valve opened, so that further flow of fluid through valve 2, is into the compressor. The apparatus may of course, be used with a typical gauge and vacuum pump arrangement which allows the tubing 6 to be evacuated of air and moisture before refrigerant is allowed to flow therethrough. The flow rate of fluid is controlled by manually rotating body 14 relative to stem 16. Reverse flow of fluid from the compressor into the container is blocked by the same ball and valve seat arrangement. In addition, excessive pressure conditions within the tubing 6 and stem 16 are indicated by leakage of fluid around the O-ring seal 42.

While the present invention and its use have been illustrated in terms of particular apparatus, it is apparent that various modifications and changes may be made within the scope of the present invention as defined by the appended claims.

I claim:

1. Can tapping valve apparatus for transferring pressurized fluid from a container to an outlet comprising:

a generally cylindrical body member having at least a portion of its outer surface threaded for engagement with said container, a fluid flow passageway extending longitudinally along its axis, a valve seat disposed in said flow passageway and a threaded inner surface at a first end of said body member;

means connected to said body member for piercing said container, including fluid sealing means carried within a second end of said body member for forming a seal between said second end and the container;

a generally cylindrical stem member attached to said first end of said body member having a fluid flow passageway extending along its axis, means on a first end of said stem member for coupling to said outlet, a threaded portion on a second end of said stem member engaged with the threaded inner surface of said body member whereby spacing between the second end of said stem member and the valve seat in said body member is adjustable by rotation of said stem member relative to said body member;

an elastomeric ball disposed between said valve seat in said body member and the second end of said stem member; and sealing means carried on the second end of said stem member for providing a fluid tight seal at a predetermined pressure level between said stem and body members, whereby excessive pressure levels are indicated by fluid leakage.

2. In can tapping valve apparatus for transferring fluid from a pierceable pressurized container of the type having a threaded outer surface for engagement with a container gripping means, piercing and sealing means for placing said valve apparatus in fluid tight communication with said container, and flow control valve means and check valve means, an improved combination flow control and check valve comprising:

a generally cylindrical body member having a flow path along its axis and carrying said threaded outer surface and piercing and sealing means at a first end and a valve seat intermediate said first end and a second end;

a generally cylindrical stem member having a flow path along its axis, a first end within and in threaded engagement with said body flow path at said second end of said body;

an elastomeric valve ball carried within said body flow path between said valve seat and said stem; and sealing means carried on said first end of said stem member adapted for providing, at pressures below a safe operating level, a fluid tight seal between said body and said stem, whereby excessive pressure is indicated by fluid leakage.

* * * * *